US009652940B1

(12) United States Patent
Matturro

(10) Patent No.: US 9,652,940 B1
(45) Date of Patent: May 16, 2017

(54) LOTTO SPORTS GAME

(71) Applicant: Paul Matturro, Eastchester, NY (US)

(72) Inventor: Paul Matturro, Eastchester, NY (US)

( * ) Notice: Subject to any disclaimer, the term of this patent is extended or adjusted under 35 U.S.C. 154(b) by 206 days.

(21) Appl. No.: 14/311,951

(22) Filed: Jun. 23, 2014

Related U.S. Application Data

(60) Provisional application No. 61/839,593, filed on Jun. 26, 2013.

(51) Int. Cl.
*G07F 17/32* (2006.01)

(52) U.S. Cl.
CPC ..... *G07F 17/329* (2013.01)

(58) Field of Classification Search
USPC ..... 463/16, 17
See application file for complete search history.

(56) References Cited

U.S. PATENT DOCUMENTS

2004/0087356 A1* 5/2004 Collins ..... G07F 17/3288 463/17
2010/0069137 A1* 3/2010 D'Angelo ..... A63F 3/0615 463/17

* cited by examiner

*Primary Examiner* — Pierre E Elisca
(74) *Attorney, Agent, or Firm* — Marvin Petry; Stites & Harbison, PLLC

(57) ABSTRACT

A method and system for a lotto-style game is provided in which a single random number, in a universe of 1-100, is generated and corresponds to a specific pre-numbered box in a two dimensional grid. This box will represent a lotto player's score related to a specific sporting game and date selected by the player. Random numbers will be generated each time a player purchases a ticket based on the date, and teams (game) chosen by the player. A system for playing a lottery game is also provided.

16 Claims, 7 Drawing Sheets

EXCITING NEW GAME CONCEPT

THE N.Y. LOTTO FOOTBALL POOL

Introducing a new and exciting lotto game which combines the "pre-approved" random number generator of an existing lotto game (Quick Draw) with a traditional, extremely popular football ritual.

FIG. 2

HOW IT WORKS?

- Each game has 100 boxes from 0-9 horizontally and vertically like your traditional box pool
- Boxes drawn randomly – similar to quick draw
- One box drawn for each sale
- That box corresponds to the individuals "Lucky Ticket Score"
- Once all 100 boxes are drawn, a new game is generated

FIG. 3

BENEFITS

- Will attract NEW lotto customer's
- Will generate Millions of $ for N.Y. Education
- Pay-outs non-taxabale to individuals
- High % of winners to players
- As people participate, they will be more inclined to go out to restaurants, etc. to watch these games = generating more revenue to the state and community

FIG. 4

PRIZES AND PROFITS

Winners – Based on $10 Game

| | NY Lotto Customer | New York |
|---|---|---|
| 1st Qtr. | $ 100 | - |
| 1st Half | $ 100 | - |
| 3rd Qtr. | $ 100 | - |
| Final | $ 500 | $200 |
| TOTAL | $ 800 | $200 |

FIG. 5

NEW YORK INCOME PER GAME LEVEL

| Game Level | New York Income |
|---|---|
| $ 1 | $ 20 |
| $ 5 | $ 100 |
| $ 10 | $ 200 |
| $ 20 | $ 400 |
| $ 30 | $ 600 |
| $ 50 | $ 1,000 |

FIG. 6

LOTTO SPORTS GAME

CROSS-REFERENCE TO RELATED APPLICATION

This application claims the benefit of U.S. Provisional Patent Application Ser. No. 61/839,593, filed Jun. 26, 2013, herein incorporated by reference.

SUMMARY OF THE INVENTION

The present invention is a unique type of lotto game whereby a single random number (in a universe of 1-100) is generated and will correspond to a specific pre-numbered box in a two dimensional grid. This box will represent the player's score related to a specific sporting game and date selected by the player. Random numbers will be generated each time a player purchases a ticket based on the date, and teams (game) chosen by the player. For convenience, the word "GAME" (all caps) will refer to the present lotto GAME while the word "game" (lower case) will refer to sporting events. The GAME, as outlined above, will use a grid with single digits zero to nine arranged horizontally (for example, the home team) and another set of single digits zero to nine arranged vertically (for example, the visiting team) such that these horizontal and vertical numbers form a grid with 100 boxes, each located at the intersection of one of the ten horizontal numbers and one of the ten vertical numbers. The digits represent the last digit of the score of the two teams at selected points in time in the game. For example, in a football game it might represent the last digit of each team's score after the first quarter, the second quarter, the third quarter and/or after the end of the game. Often prize value will increase for the later points in time with the greatest reward being for the final score. The GAME is applicable in particular to sporting events wherein the teams generally accrue over 10 points so that a last digit of any team's score between zero and nine would be a viable number. Such sports would include football and basketball.

BRIEF DESCRIPTION OF THE DRAWINGS

By way of example, the present invention will be described as applied to football wherein the score generally exceeds ten points per team so that the last digit of any team's score could readily be any digit between zero and nine.

FIGS. 1 to 6 illustrate the operation and advantages of the present invention as applied to the specific application of professional football in the context of a New York lottery. These figures demonstrate the nature of the GAME, how to play the GAME and the commercial and other advantages of the GAME.

DETAILED DESCRIPTION

Figure 1:
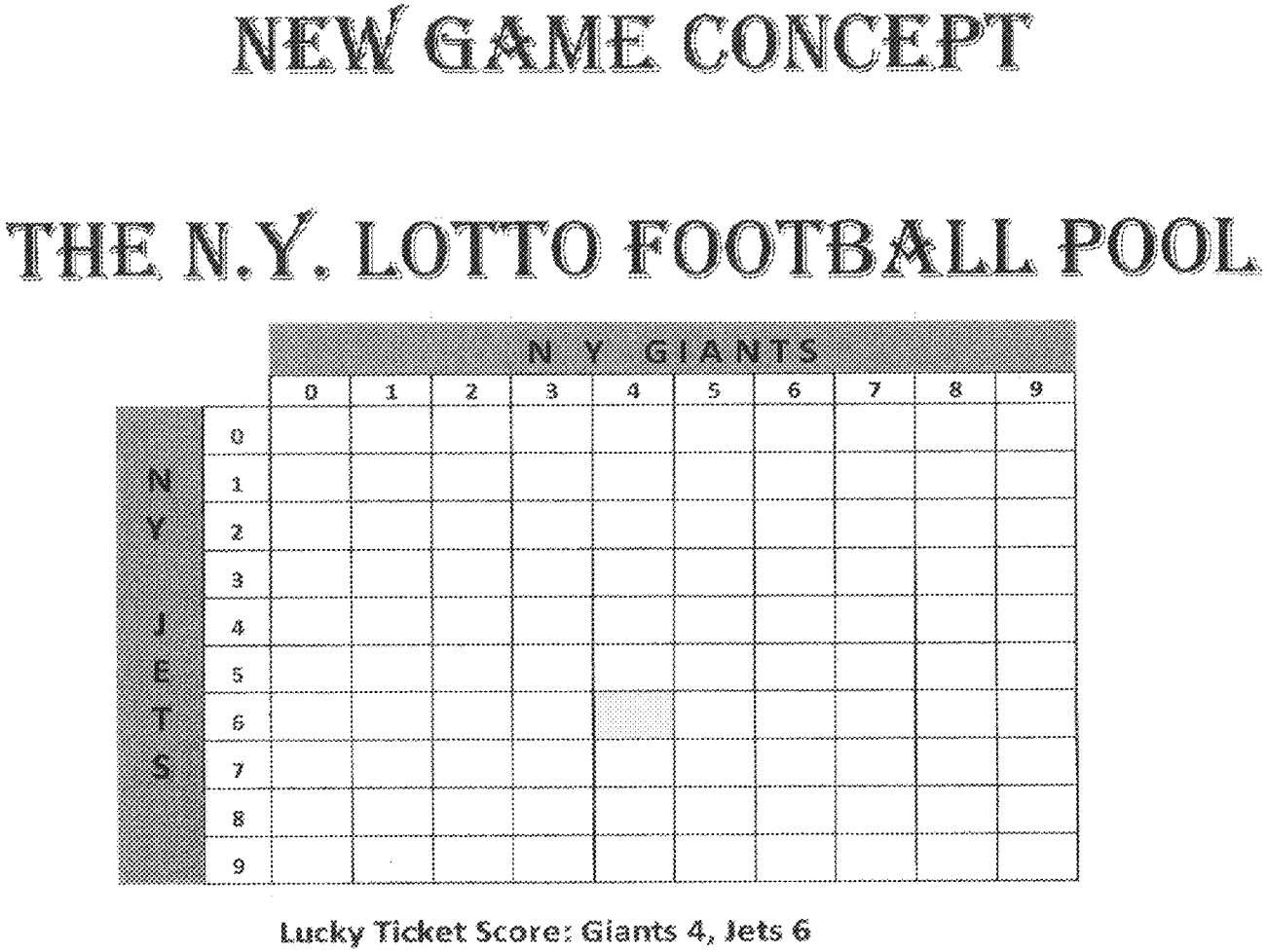

Referring now to the figures, FIG. 1 include a grid which would be applicable for a specific game, namely a game wherein the New York Jets (the visiting team) are playing at the New York Giants (the home team) on a certain date. The grid boxes are numbered zero through nine horizontally for the home team and zero through nine vertically for the visiting team, hence a total of 100 boxes.

Professional football, for example National Football League games, would be particularly suitable for the present GAME. First, obviously professional football is enormously popular and would draw enormous interest. Second, the NFL has a large schedule which is well-known and well-defined in advance. Specifically, for the regular season, each of the 32 teams plays 16 games so that there are a total of 256 games, each uniquely identifiable. Obviously the GAME could include pre-season games and, once the play-off teams are known, the playoff games, right up to the Super Bowl.

Referring to the example of FIG. 1, when the GAME is played, in the manner to be described in greater detail below, if a player pays an amount for a single bet, the central server will generate a random number between 1-100 and that number will correspond to a unique box within the grid. That box would then be translated into the player's lucky score (see FIG. 1) which matches a number on the horizontal line and a number which matches a number on the vertical line. Of course a player may make different bets for a given game, each one being randomly assigned a different box on the grid and the GAME will have varying dollar amounts per bet as the operators of the GAME or the player desire. The GAME grid shown in FIG. 1 would be only one of the 256 regular season NFL games, namely the one where the New York Jets play at the home stadium of the New York Giants. In the illustration, the player made one bet and the computer randomly assigned for that player one horizontal number 4 and vertical number 6 which corresponds to a specific box, as shown in gray in FIG. 1B so that the player's "lucky score" is Giants 4, Jets 6. Since these represent only the last digits, this player would win if at any of the specified times in the game, the Giant's score was 4, 14, 24, 34, etc. and the Jet's score was 6, 16, 26, 36, etc.

While only 100 bets could be made for a given game on a single grid, the number of bets for that specific game is unlimited because as soon as all of the 100 boxes on a grid fill up, the central server will close out that grid and start a new grid as more bets are made on the game. There is no practical limited to the number of new grids that could be opened up for any given game.

Figure 7:
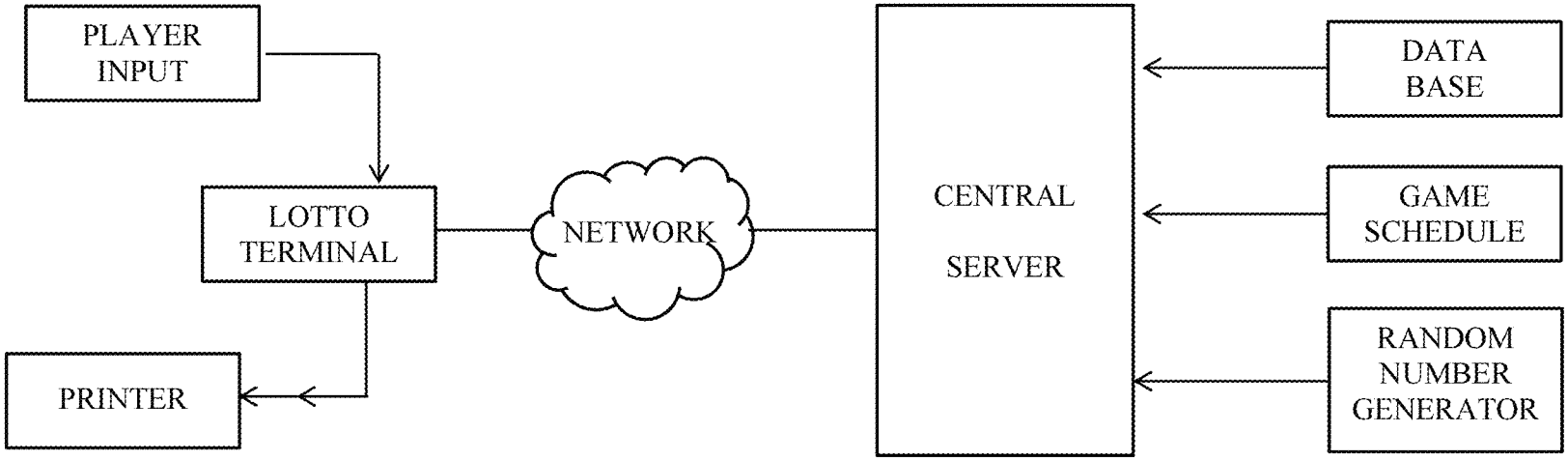
FIG. 7 is a flow chart diagram showing the system and steps utilized in the operation of the GAME.

Referring to FIG. 7, a central server has access to and/or contains applications that include the following: (1) a data base which compiles, summarizes and accounts for all game requests and sales, (2) a random number generator that randomly generates numbers zero through nine horizontally and zero through nine vertically corresponding to the 100 boxes of the grid and (3) a complete schedule of games, for example in the illustrated example, the entire NFL 2013-2014 regular season. The central server will have an interface for communicating with all remote lotto terminals, via any suitable connection type (e.g. a network connection) only one of which is shown in FIG. 7. Each lotto terminal will receive the player input, i.e., the player's requested bet or bets, and will include or be coupled with a printer to print out the player's ticket.

At the player input, the player will select a specific game, for example by identifying the home team and the date. The lotto terminal will transmit a request corresponding to this selection to the central server, which will recognize this as corresponding to a specific one of the 256 games during the NFL regular season. The player will select a dollar value, for example, $5.00 and the number of bets, meaning the number of boxes on the grid to be purchased. This request will be transmitted to the central server where it will be fulfilled.

The process of fulfilling the request comprises the following. The central server will identify a request as applying to a specific game based on teams, date, and bet amount determined by the player. The server will then access a random number application whereby a random number between 1-100 will be generated, and correspond to a predetermined internally numbered box within that game's grid. Predetermined internal boxes will be identified by box 1 in the upper left box followed by internal numbered box 2 in the box on the same horizontal line to its right, box three will be the box on the same horizontal line to the right of box 2 and so on until all 100 boxes are internally numbers such that the bottom box in the bottom right horizontally and vertically will be internal box 100. Alternatively, where the player makes more than one bet on a given game at any given time, the player could receive one ticket with all bets (assigned boxes) marked thereon or a single ticket for each bet.

Because the entire NFL regular season's schedule is known and put into the central server, a player may walk in and select any one of the 256 games at any time, at any lotto terminal. As noted above, when all boxes on a single grid are filled, the central server will close out that grid and open a new grid. Thus, the number of grids for a single football game, and thus the number of bets on that football game is essentially unlimited.

Although the GAME is capable of being played throughout the entire country, it must in practice be played only where it has state approval. However, if state approval is not considered, or viewed differently, if every state approves the game, terminals can be placed ubiquitously like Powerball terminals throughout the country and with sufficient computer capacity, which is well known, taking every NFL regular season game as an example, anyone in the country can on any given day walk up to any terminal and place any number of bets at anyone of the yet unplayed 256 NFL games. The number of bets placed would be staggering and the number of bets placed on the Super Bowl is unimaginable.

As shown in the FIG. 1 through 6, and in particular, FIG. 4, the GAME can provide an enormously increased level of enjoyment to the participants. For example, unlike numbered lotteries wherein the moment of excitement is simply the few minutes of listening to the winning lottery numbers, in a grid-type game, the player knows his or her number during the game and thus has a heightened interest throughout the entire game. This aspect of a grid game is of course the same as in an office grid-type pool wherein each person manually selects a box on the grid prior to the game. However, the present GAME carries this type of interest to a whole new level, namely beyond the single location of the office pool to potentially every home, restaurant or bar where NFL fans are watching games.

Additionally, since lotto games are run by governments such as states, revenues generated by increased bets will create more revenue for the state and the community.

It will now be clear that the present invention provides features and advantages not found in prior known compositions and treatments. Further, one of ordinary skill in the art will recognize that aspects of the present disclosure can be modified using routine techniques consistent with the present disclosure.

The invention claimed is:

1. A system for playing a lottery game, said system comprising:

a computer server having a processor configured to generate a random number corresponding to the last digits of respective scores of two sports teams playing a match in advance of the match occurring;

a database operatively associated with the computer server, said database having data regarding matches to be played between two sports teams including respective dates of the matches and teams playing; and a user interface operatively associated with the computer server, said user interface having a user interface processor allowing a user to select a specific match from among those for which data is maintained in the database and to place a bet that corresponds to a request to be assigned a unique pair of last digit scores for a game associated with the selected match;

a display or printer associated with the user interface for displaying or printing the unique pair of last digit scores assigned for the bet requested by the user, and wherein the computer server generates a random number for each bet placed by a user that corresponds to a request to be assigned a pair of last digit scores in response to the bet being placed that is unique among all pairs of last digit scores assigned for bets placed by users for the game associated with the selected match.

2. The system of claim 1, wherein the computer server generates random numbers between 1 and 100 corresponding to a respective pair of coordinates of a 10×10 array, the coordinates having values from 0 to 9, each value for the coordinates of the pair of coordinates representing the last digit of a respective score of two sports teams playing a match.

3. The system of claim 2, wherein the computer server assigns the pair of scores requested by the user based on a randomly generated number between 1 and 100.

4. The system of claim 2, wherein the display or printer associated with the user interface displays or prints the unique pair of last digit scores assigned for the bet requested by the user as a 10-by-10 grid of 100 boxes in which numbers from 0 to 9 are sequentially respectively assigned to the 10 columns of the grid along an x-axis and to the 10 rows of the grid along a y-axis, the two sports teams are respectively assigned to x and y axes of the grid, and the unique pair of last digit scores assigned for the bet requested by the user is indicated by marking the box of the grid that is located within the column to which the number respectively assigned thereto matches the last digit score assigned for the bet for the sorts team respectively assigned to the x-axis of the grid and within the row to which the number respectively assigned thereto matches the last digit score assigned for the bet for the sports team respectively assigned to the y-axis of the grid.

5. The system of claim 4, wherein the user interface processor allows the user to specify, in conjunction with selecting a specific match from among those for which data is maintained in the database, a quantity of bets to be placed that each correspond to a respective request to be assigned a unique pair of last digit scores for the game associated with the selected match.

6. The system of claim 5, wherein the display or printer associated with the user interface indicates the unique pair of last digit scores assigned for each bet of the specified quantity of bets requested by the user within the 10-by-10 grid that is displayed or printed by marking the box of the grid that is located within the column to which the number respectively assigned thereto matches the last digit score assigned for the bet for the sports team respectively assigned to the x-axis of the grid and within the row to which the number respectively assigned thereto matches the last digit score assigned for the bet for the sports team respectively assigned to the y-axis of the grid.

7. The system of claim 1, wherein, for each game associated with each match to be played between two sports teams for which data is maintained in the database, the computer server generates unique random numbers between 1 and 100, one at a time, respectively for bets placed by users requesting to be assigned with unique pairs of last digit scores for the game, until all 100 numbers have been generated and, upon all 100 numbers being generated for the game, generates a new game associated with the match and repeats a process of generating a next set of unique random numbers between 1 and 100, one at a time, respectively for bets placed by users requesting to be assigned with unique pairs of last digit scores for the new game, until all 100 numbers have been generated.

8. The system of claim 1, wherein the computer server is configured to randomly generate numbers between 1 and 100.

9. The system of claim 8, wherein the computer server assigns the pair of scores requested by the user based on a randomly generated number between 1 and 100.

10. The system of claim 1, wherein the computer server generates two random single-digit numbers for each user request to be assigned with a pair of scores for a game associated with a match to be played between two sports teams in which each random number generated corresponds to a last digit of a score of one of the teams playing the match.

11. The system of claim 1, wherein the matches for which data is maintained in the database comprise a set of scheduled, upcoming matches in a season or tournament for each of one or more sports leagues.

12. The system of claim 1, wherein each pair of last digit scores assigned for bets placed by users for the game associated with the selected match correspond to the last digits of respective scores of the two sports teams playing the match at one or more predetermined points in play during the match.

13. The system of claim 12, wherein the match is a football game, and wherein the predetermined points in play during the match comprises an end point in time for each quarter of the football game.

14. The system of claim 1, wherein the user interface is implemented on a terminal that includes the user interface processor, and wherein the terminal is communicatively coupled to the computer server via a network.

15. The system of claim 14, wherein, in response to each bet placed by users for the game associated with the selected match using the user interface implemented on the terminal, the terminal transmits information pertaining to the bet to the computer server via the network, and wherein, in response to receiving the information pertaining to each bet placed by users for the game associated with the selected match using the user interface implemented on the terminal, the computer server transmits the unique pair of last digit scores assigned for the bet to the terminal via the network and stores the information pertaining to the bet and the unique pair of last digit scores assigned for the bet in the database in association with data regarding the selected match that is maintained therein.

16. The system of claim 14, wherein the terminal is communicatively coupled to or includes the display or printer.

* * * * *